US010527280B2

(12) United States Patent
Rauch

(10) Patent No.: US 10,527,280 B2
(45) Date of Patent: Jan. 7, 2020

(54) HIGH ORGANIC CONCURRENT DECOATING KILN

(71) Applicant: NOVELIS INC., Atlanta, GA (US)

(72) Inventor: Edwin L. Rauch, Fulton, NY (US)

(73) Assignee: NOVELIS INC., Atlanta, GA (US)

( * ) Notice: Subject to any disclaimer, the term of this patent is extended or adjusted under 35 U.S.C. 154(b) by 133 days.

(21) Appl. No.: 15/307,708

(22) PCT Filed: May 22, 2015

(86) PCT No.: PCT/US2015/032189
§ 371 (c)(1),
(2) Date: Oct. 28, 2016

(87) PCT Pub. No.: WO2015/179770
PCT Pub. Date: Nov. 26, 2015

(65) Prior Publication Data

US 2017/0051914 A1 Feb. 23, 2017

Related U.S. Application Data

(60) Provisional application No. 62/001,764, filed on May 22, 2014.

(51) Int. Cl.
*F27B 7/36* (2006.01)
*F23G 5/027* (2006.01)
(Continued)

(52) U.S. Cl.
CPC ..... *F23G 5/027* (2013.01); *B08B 7/0085* (2013.01); *F23G 5/20* (2013.01); *F27B 7/36* (2013.01); *F27D 7/02* (2013.01); *F27D 17/00* (2013.01)

(58) Field of Classification Search
CPC .. F27B 7/362; F26B 23/02; F26B 5/08; C22B 9/16
See application file for complete search history.

(56) References Cited

U.S. PATENT DOCUMENTS 4,548,651 A * 10/1985 Ramsey ..... C22B 1/005 134/18
4,840,129 A * 6/1989 Jelinek ..... C10B 1/10 110/226
(Continued)

FOREIGN PATENT DOCUMENTS

| | | |
|---|---|---|
| EP | 109768 | 5/1984 |
| JP | 2004225935 | 8/2004 |
| JP | 2004225935 A * | 8/2004 |

OTHER PUBLICATIONS

PCT/US2015/032189, "International Preliminary Report on Patentability", dated Dec. 1, 2016, 9 pages.
(Continued)

*Primary Examiner* — Gregory A Wilson
(74) *Attorney, Agent, or Firm* — Kilpatrick Townsend & Stockton LLP

(57) ABSTRACT

A high organic concurrent decoating kiln includes a low-oxygen zone and a high-oxygen zone. The disclosed kiln allows a gas low in free oxygen to be used in the initial stages of decoating, while a gas higher in free oxygen can be used in the final stages. The total amount of free oxygen used throughout the kiln, in particular at the upstream portion of the kiln, is kept low. Exhaust gas can be recirculated for use in a burner-fired chamber that provides the initial low-oxygen gas to the kiln.

16 Claims, 3 Drawing Sheets

(51) Int. Cl.

| | |
|---|---|
| ***F27D 7/02*** | (2006.01) |
| ***F27D 17/00*** | (2006.01) |
| ***B08B 7/00*** | (2006.01) |
| ***F23G 5/20*** | (2006.01) |

(56) References Cited

U.S. PATENT DOCUMENTS 6,227,847 B1 * 5/2001 Gillespie ..... F23G 5/02 110/236
8,578,869 B2 * 11/2013 Meng ..... F23G 5/027 110/185
8,771,586 B2 * 7/2014 Meng ..... F23G 5/0276 110/246

OTHER PUBLICATIONS

PCT/US2015/032189, "International Search Report and Written Opinion", dated Jul. 28, 2015, 11 pages.
KR Patent Application No. 10-2016-7035444 , "KIPO's Notice of Final Rejection", dated Apr. 30, 2018, 7 pages, with English translation.
KR Patent Application No. 10-2016-7035444 , "KIPO's Notice of Preliminary Rejection", dated Oct. 24, 2017, 15 pages, with English translation.
Communication pursuant to Article 94(3) EPC issued for EP Application No. 15727799.7 dated Sep. 6, 2018, 6 pages.
Korean Patent Application No. KR 10-2016-7035444, Office Action dated Jul. 3, 2018, 6 pages.
European Patent Application No. 15727799.7 , Office Action dated Feb. 9, 2018, 6 pages.
Office Action issued for Korean Application No. 10-2018-7022345 dated Nov. 12, 2018 along with an English translation (11 pages).
Decision issued by Korean Intellectual Property Trial and Appeal Board in Korean Patent Application No. 10-2018-7022345 on Oct. 29, 2019, along with an English translation, 28 pages.
Office Action issued by Korean Intellectual Property Office in Korean Patent Application No. 10-2018-7022345 dated Oct. 30, 2019, along with an English translation, 5 pages.
Decision issued by Korean Intellectual Property Trial and Appeal Board in Korean Patent Application No. 10-2016-7035444 on Oct. 29, 2019, along with an English translation, 28 pages.

* cited by examiner

HIGH ORGANIC CONCURRENT DECOATING KILN

CROSS REFERENCE TO RELATED APPLICATIONS

The present application claims the benefit of U.S. Provisional Application No. 62/001,764 filed on May 22, 2014, entitled "HIGH ORGANIC CONCURRENT DECOATING KILN," the contents of which are hereby incorporated by reference in their entirety.

TECHNICAL FIELD

The present disclosure relates to metal recycling generally and more specifically to decoating metal during recycling.

BACKGROUND

During metal recycling, such as recycling aluminum (including aluminum alloys), organic coatings, such as paints, lacquers, and the like must be removed. Metal scrap can be crushed, shredded, or chopped into smaller pieces. The smaller pieces are then decoated, melted, and recovered.

Decoating is an important step that prevents violent gas evolution during melting. In concurrent decoating kilns, the process gas can become saturated with pyrolysis gases, rendering the decoating process difficult to control and leading to poor decoating. Existing decoating kilns may leave residual carbon residue on the scrap material, which can decrease the efficiency of post-decoating processes, including melting.

In concurrent decoating kilns, the percentage of free oxygen at the entry side of the kiln can begin relatively high and slowly decrease as pyrolysis gases build up. Concurrent decoating kilns are not capable of providing a higher oxygen level at the exit end of the kiln than the entry level of the kiln. Since good decoating requires free oxygen during the final stages, concurrent decoating kilns rely upon higher free oxygen content at the entry end. In some cases, the free oxygen is fully consumed in the kiln and decoating in the final stages is compromised. In other cases, the large amounts of free oxygen left in the mixed gases can allow the mixture to ignite and overheat components, such as when sent through the exhaust ductwork, fans, or other parts.

SUMMARY

The term embodiment and like terms are intended to refer broadly to all of the subject matter of this disclosure and the claims below. Statements containing these terms should be understood not to limit the subject matter described herein or to limit the meaning or scope of the claims below. Embodiments of the present disclosure covered herein are defined by the claims below, not this summary. This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this disclosure, any or all drawings and each claim.

Disclosed are high organic concurrent decoating kilns that include a low-oxygen zone and a high-oxygen zone. The disclosed kilns allow a gas low in free oxygen to be used in the initial stages of decoating, while a gas higher in free oxygen is used in the final stages. The total amount of free oxygen used throughout the kiln, particularly at the upstream portion of the kiln, is kept low, which reduces the risk of fires.

Additionally, the exhaust gases leaving the decoating kiln are incombustible because the free oxygen content is sufficiently low. These exhaust gases can be reused to provide fuel to the burner-fired chamber that generates the low free oxygen gases that initially enter the kiln.

The disclosed kiln can provide more efficient and safer decoating of metal scrap, as well as the ability to decoat previously undesirable materials.

BRIEF DESCRIPTION OF THE DRAWINGS

The specification makes reference to the following appended figures, in which use of like reference numerals in different figures is intended to illustrate like or analogous components.

DETAILED DESCRIPTION

Disclosed is a high organic concurrent decoating kiln that includes a low-oxygen zone and a high-oxygen zone. The disclosed kiln allows a gas low in free oxygen to be used in the initial stages of decoating, while a gas higher in free oxygen is used in the final stages. The total amount of free oxygen used throughout the kiln, in particular at the upstream portion of the kiln, is kept low, reducing the risk of fires. Because the free oxygen content is kept sufficiently low, the exhaust gases leaving the decoating kiln are incombustible. These exhaust gases can be reused to provide fuel to the burner-fired chamber that generates the low free oxygen gases that initially enter the kiln.

The disclosed kiln can provide more efficient and safer decoating of metal scrap, as well as the ability to decoat previously undesirable materials.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be drawn not to scale.

Figure 1:
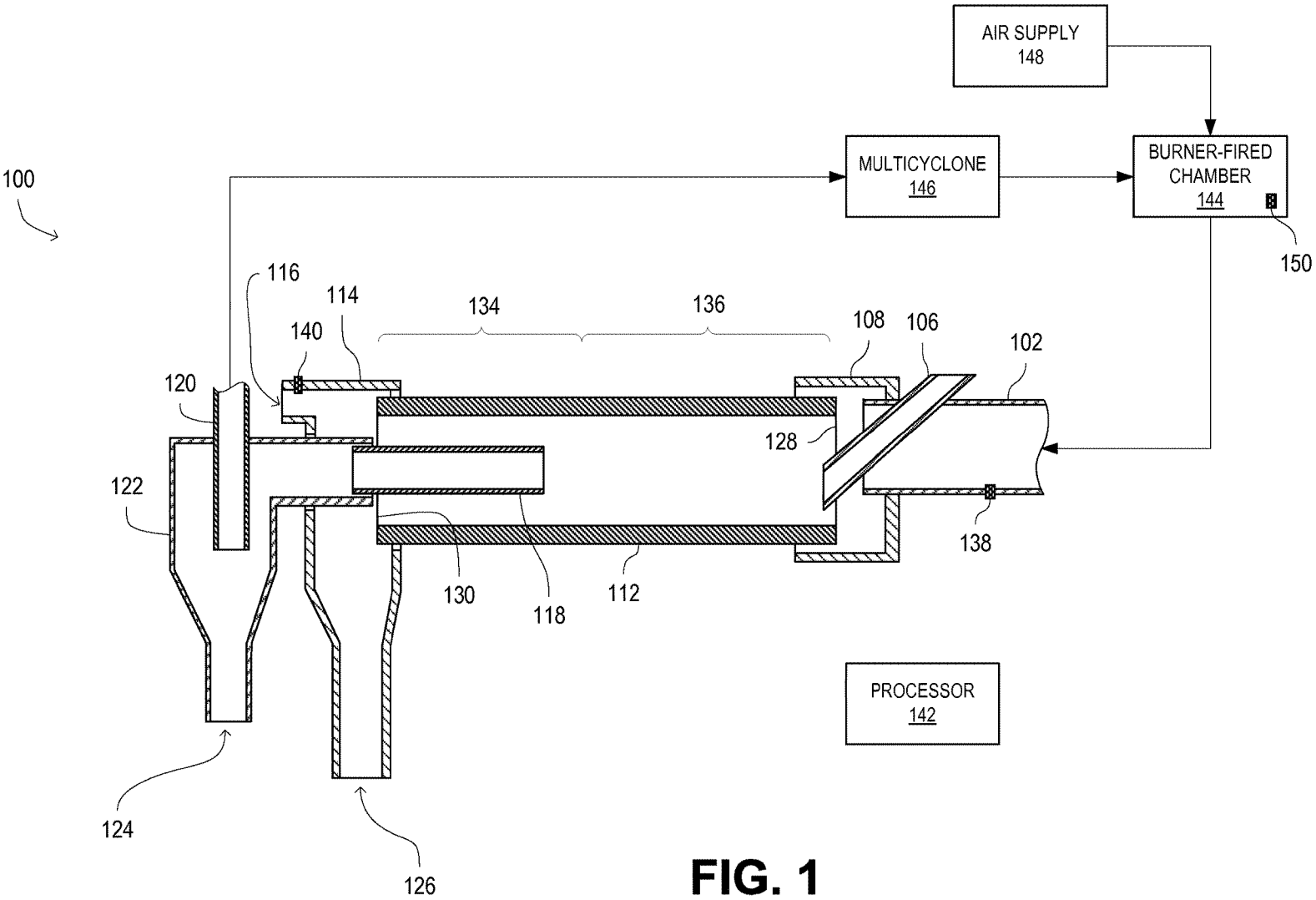
FIG. 1 is a cross-sectional view depicting a high organic concurrent decoating kiln according to one aspect.

FIG. 1 is a cross-sectional view depicting a high organic concurrent decoating kiln 100. The high organic concurrent decoating kiln 100 includes a rotating drum 112 supported between a first chamber 108 and a second chamber 114. The rotating drum 112 has an entry end 128 proximate the first chamber 108 and an exit end 130 proximate the second chamber 114. A scrap chute 106 is positioned within the first chamber to allow coated scrap to enter the rotating drum 112 through the entry end 128.

A low-oxygen hot gas entry duct 102 in the first chamber 108 allows low-oxygen hot gas to enter the rotating drum 112 at an upstream portion of the kiln. The low-oxygen hot gas may be exhaust from a burner-fired chamber 144 external to the high organic concurrent decoating kiln 100 or may come from any suitable source. In some cases, the low-oxygen hot gas can have less than approximately 10%, less than approximately 5%, or between approximately 1%-2% oxygen. The low-oxygen hot gas enters the rotating drum 112 at a first flow velocity. The low-oxygen hot gas can vaporize and pyrolize coatings on the scrap. The low-oxygen hot gas entering the rotating drum 112 at the entry end 128 holds the oxygen level extremely low in a low-oxygen zone 136. As coated scrap passes through the low-oxygen zone 136 from the entry end 128 towards the exit end 130, scrap can be coated with a residue that is high in carbon.

A high-oxygen hot gas enters the rotating drum 112 through a high-oxygen hot gas entry duct 116 in the second chamber 114 at a downstream portion of the kiln. The high-oxygen hot gas can have more than approximately 10% oxygen and, in some cases, between approximately 10% and approximately 25% oxygen or between approximately 5% oxygen and up to 25% oxygen. The high-oxygen hot gas can enter the rotating drum 112 at a second flow velocity that is lower than the first flow velocity. The high-oxygen hot gas entering the rotating drum 112 at the exit end 130 holds the oxygen level high in a high-oxygen zone 134. The oxygen levels (e.g., levels of free oxygen) in the high-oxygen zone 134 support the thermal/oxidation removal of the residue left on the scrap from the low-oxygen zone 136. Removal of residues increases the efficiency of post-decoating processes, including melting. Additionally, because oxygen levels are maintained at low levels within the low-oxygen zone 136, pyrolysis gases are generated without any substantial increased risk of fires.

A low-oxygen hot gas sensor 138 may be positioned in the low-oxygen hot gas entry duct 102 to measure the oxygen content of the low-oxygen hot gas entering the rotating drum 112. A high-oxygen hot gas sensor 140 may be positioned in or near the high-oxygen hot gas entry duct 116 to measure the oxygen content of the high-oxygen hot gas entering the rotating drum 112. Sensors 138, 140 are connected to a processor 142 that controls the flow rate of the low-oxygen hot gas and high-oxygen hot gas that enter the rotating drum 112 to control the oxygen levels in the high-oxygen zone 134 and the low-oxygen zone 136. If the processor 142 determines the oxygen levels in either the high-oxygen zone 134 or low-oxygen zone 136 are outside the desired ranges, the processor 142 adjusts the flow rate of either the low-oxygen hot gas or the high-oxygen hot gas to bring the oxygen levels back into the desired ranges. Sensors 138, 140 may be positioned in other locations as necessary (e.g., within the rotating drum 112) to ensure proper oxygen levels within the rotating drum 112. In one non-limiting example, sensors 138, 140 are zirconia/platinum or platinum/ceramic and can be equipped with wireless transmission capability, but other suitable sensors may be used. Any suitable sensor, such as but not limited to a wireless transmitting thermocouple, may be used to measure the temperature of the scrap moving through the rotating drum 112.

An exhaust tube 118 is positioned within the rotating drum 112 at the exit end 130. Gases within the rotating drum 112, including the high-oxygen hot gas and the low-oxygen hot gas, exit the rotating drum 112 through the exhaust tube 118.

A portion of the decoated scrap may become entrained in the exhaust gas, thus exiting the rotating drum 112 through the exhaust tube 118. The remaining decoated scrap exits the rotating drum 112 through the exit end 130, into the second chamber 114 and out a first scrap exit port 126. Entrained scrap that exits through the exhaust tube 118 enters a cyclone 122 designed to separate entrained scrap, which falls out of the cyclone 122 and out a second scrap exit port 124. The cyclone 122 is designed so it does not separate out dust-sized particles, which are carried up, along with the exhaust gas, through a cyclone top exit port 120. The dust-sized particles and exhaust gas that exit the cyclone 122 through the cyclone top exit port 120 are carried to a multicyclone 146. The multicyclone 146 separates most of the dust-sized particles from the remaining exhaust gas by forcing the gases to spin and send the particles against the walls of the cyclone tubes where the particles slow and drop out the bottom, while the cleaned gas migrates to the center tube and exits. A filter other than a multicyclone 146 may be used to separate out dust-sized particles from the remaining exhaust gas. The remaining exhaust gas has a low free oxygen level and is incombustible, yet still has significant fuel value. The exhaust gas passes through a high temperature fan and into the burner-fired chamber 144. An oxygen sensor 150 may be positioned in or proximate the burner-fired chamber 144 to determine the percentage of oxygen in the burner-fired chamber 144. Air enters the burner-fired chamber 144 from air supply 148 to maintain a slightly oxidizing condition within the burner-fired chamber 144. The oxygen sensor 150 may be connected to processor 142, which then controls the air entering the burner-fired chamber 144 from the air supply 148. In alternate examples, exhaust gas from the cyclone 122 is not reused and is not fed into the burner-fired chamber 144. In some cases, the air and exhaust gas burned in the burner-fired chamber 144 can be used as the low-oxygen hot gas that enters through the low-oxygen hot gas entry duct 102.

In some cases, the first scrap exit port 126 and the second scrap exit port 124 exit to the same location for further processing. In other cases, the first scrap exit port 126 and second scrap exit port 124 exit to different locations.

In some cases, bushings are present between the rotating drum 112 and both the first chamber 108 and second chamber 114 to ensure gas does not leak out of rotating drum 112.

Figure 2:
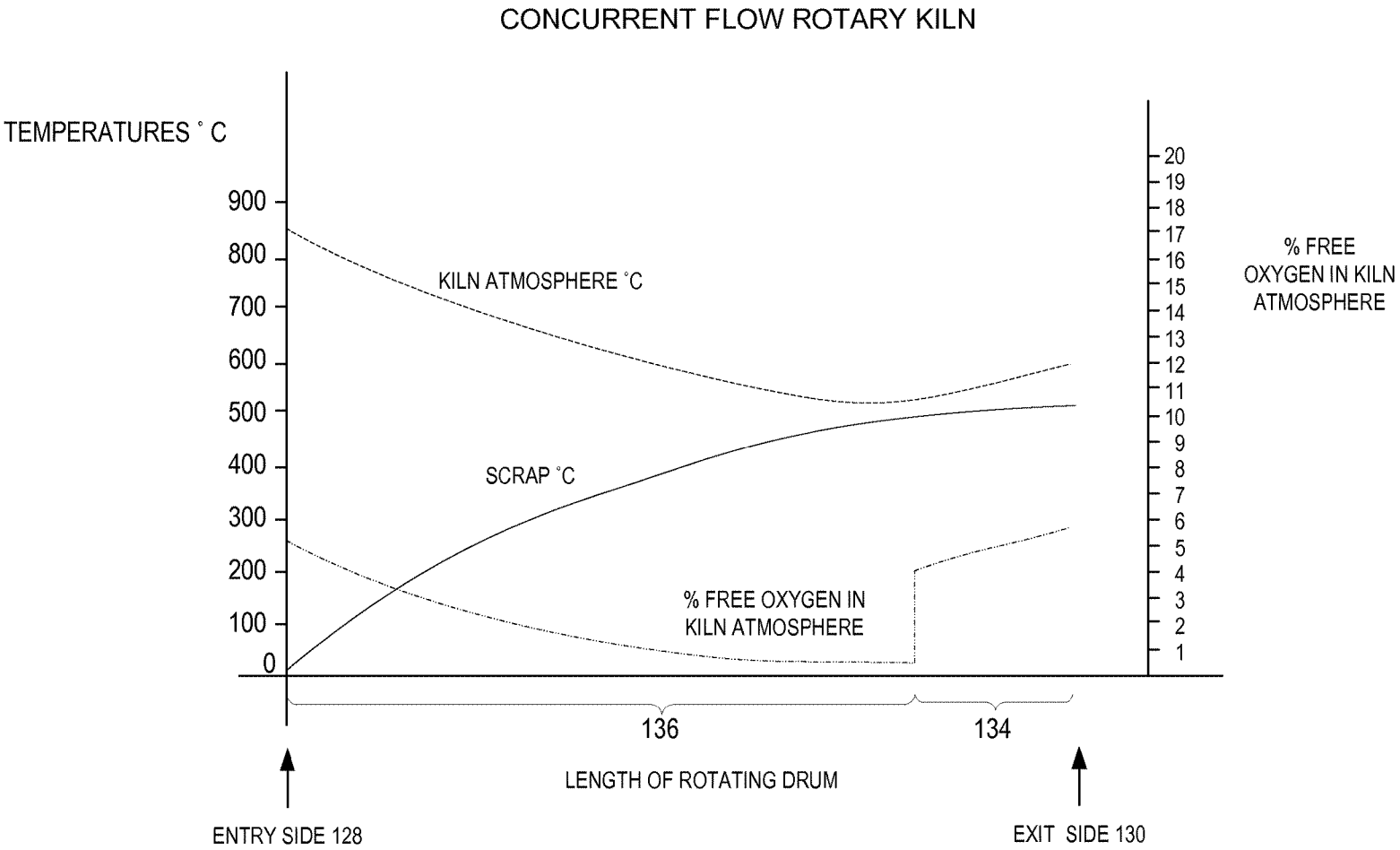
FIG. 2 is a graph depicting temperatures and free oxygen levels within a concurrent flow rotary kiln according to one aspect.

FIG. 2 is a graph depicting temperatures and free oxygen levels within a concurrent flow rotary kiln according to one non-limiting example. The solid line depicts the temperature of the scrap in ° C. as it passes through the length of the rotating drum 112 from the upstream portion to the downstream portion. At the entry side 128, the scrap begins at a low temperature (e.g., room temperature) and steadily increases to somewhere between approximately 400° C. and approximately 600° C. The scrap may exit the rotating drum 112 at the exit side 130 at approximately 500° C. The scrap can exit the rotating drum 112 from between 100° C. and 600° C. dependent on the specifics of the contamination. For example, oily material is processed between 100° C. and 200° C. Used beverage cans (UBCs) are normally processed between 500° C. and 550° C. Other suitable temperatures may be used.

The dashed line depicts the temperature of the kiln atmosphere in ° C. along the length of the rotating drum 112. The kiln atmosphere begins at the entry side 128 at above approximately 700° C., and generally at about 850° C. The kiln atmosphere steadily drops in temperature until approximately reaching the high-oxygen zone 134, at which point the kiln atmosphere slowly increases in temperature to the exit side 130. The kiln atmosphere may reach a low of below approximately 600° C., or more specifically a temperature of approximately 525° C., at the point where the low-oxygen zone 136 meets the high-oxygen zone 134. The kiln atmosphere may reach a temperature above approximately 550° C., or in some cases more specifically a temperature of approximately 600° C., at the exit side 130. Other suitable temperatures may be used.

The dotted-dashed line depicts the percentage of free oxygen in the kiln atmosphere within the rotating drum 112. In some cases, the percentage of free oxygen may begin at a low level, between approximately 4% and approximately 6%, or more specifically approximately 5%, at the entry side 128 of the rotating drum 112. The percentage of free oxygen may steadily decrease to a low of under approximately 1% at a point just before where the low-oxygen zone 136 meets the high-oxygen zone 134. The percent oxygen may then rapidly increase to between approximately 3% and approximately 5%, or more specifically approximately 4%, at the point where the low-oxygen zone 136 meets the high-oxygen zone 134. The percent oxygen within the rotating drum 112 may then steadily increase along the high-oxygen zone 134 until it reaches a high point at the exit side 130, of between approximately 5% and approximately 7%, or more specifically approximately 6%. Other suitable percentages may be used.

The unoxidized organic level within the rotating drum 112 will be near zero at the entry side 128 and increase within the low-oxygen zone 136, but will quickly lower within the high-oxygen zone 134. The oxygen level in the high-oxygen zone 134 is high enough to burn off residue, while low enough to reduce the chance of fire within the rotating drum 112.

Because of the low percentage of free oxygen within the low-oxygen zone 136, pyrolysis gas is generated more efficiently, which leads to a more efficient overall decoating system because the system is more self-fueled by pyrolysis gas.

The dual-zone nature of the disclosed kiln allows for decoating of materials such as contaminated foil pie tins and meal containers that would have been previously undesirable in prior decoating kilns.

Other decoating kilns than the high organic concurrent decoating kiln 100 described above can be used with and/or adapted to include a high-oxygen zone and a low-oxygen zone.

Figure 3:
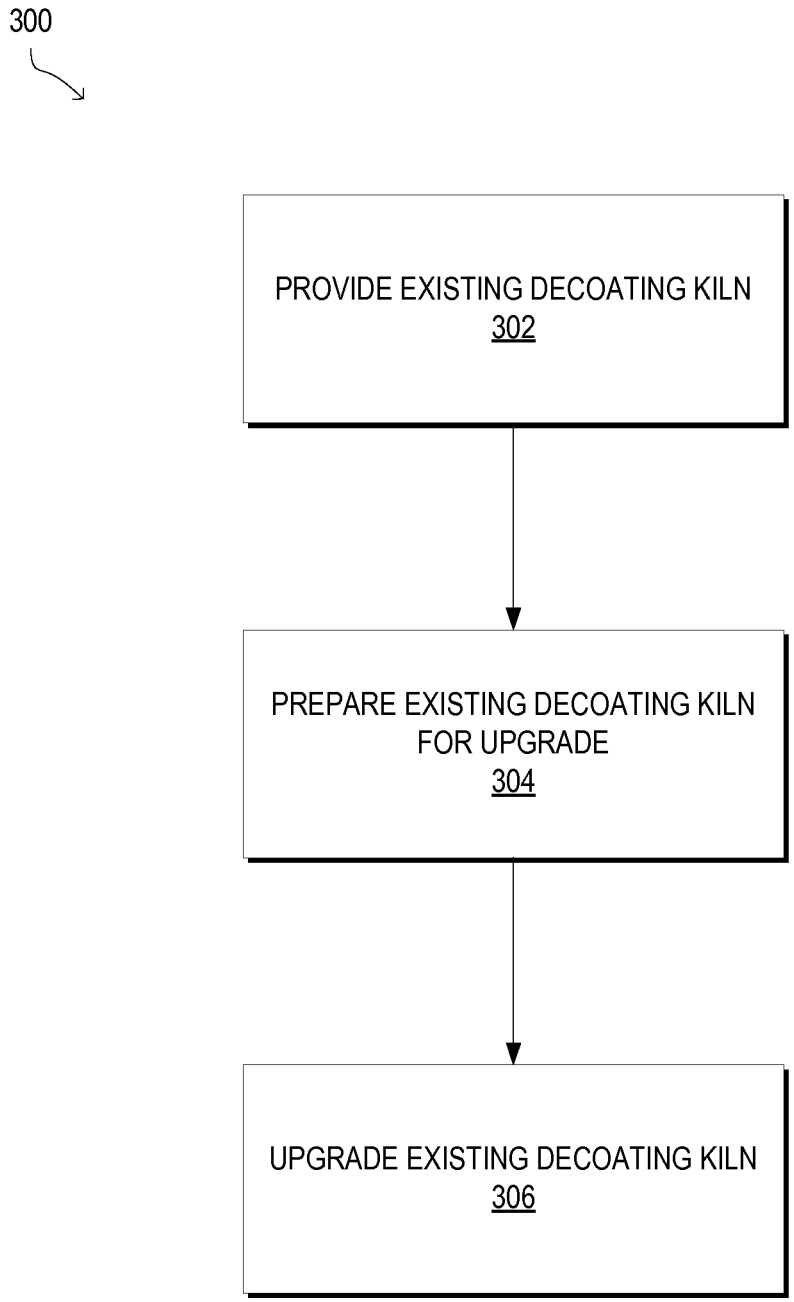
FIG. 3 is a flow chart depicting a retrofitting method according to one aspect.

FIG. 3 is a flow chart depicting a retrofitting method according to one example. An existing decoating kiln is provided at block 302. At block 304, the existing decoating kiln is prepared for upgrade. Preparing for upgrade may include replacing the existing second chamber with a second chamber 114 having an opening for the cyclone 122 and the high-oxygen hot gas entry duct 116. In some cases, an existing second chamber is modified to accept a cyclone 122 and include a high-oxygen hot gas entry duct 116. At block 306, the existing kiln is upgraded. Upgrading the existing kiln may include attaching the cyclone 122 and related parts, as well as providing ductwork to the high-oxygen hot gas entry duct 116. Additional fans, sensors, and other machinery may be added as necessary.

A kit may be provided that includes some or all parts and instructions necessary to upgrade an existing kiln to a high organic concurrent decoating kiln 100 as described herein.

The foregoing description, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a decoating kiln comprising a rotating drum comprising: an entry side for accepting metal scrap and a low-oxygen hot gas; and an exit side for outputting decoated scrap and accepting a high-oxygen hot gas; an exhaust tube positioned within the rotating drum for exhausting a mixture of exhaust gas and entrained scrap; a cyclone coupled to the exhaust tube for separating the entrained scrap from the exhaust gas; and an exit port coupled to the cyclone for exhausting the exhaust gas.

Example 2 is a decoating kiln of example 1, further comprising: a multicyclone coupled to the exit port for separating particles from the exhaust gas; and a burner-fired chamber coupled to the multicyclone for accepting the exhaust gas and generating the low-oxygen hot gas.

Example 3 is the system comprising: a decoating kiln having a low-oxygen zone proximate an entry side and a high-oxygen zone proximate an exit side.

Example 4 is the system of example 3, further comprising: a low-oxygen hot gas entry duct coupled to the decoating kiln proximate the entry side; and a high-oxygen hot gas entry duct coupled to the decoating kiln proximate the exit side.

Example 5 is the system of example 4, further comprising: an exhaust tube coupled to the decoating kiln for removing exhaust gas from the decoating kiln; and a burner-fired chamber coupled to the exhaust tube and the low-oxygen hot gas entry duct, wherein the burner-fired chamber uses at least a portion of the exhaust gas to generate a low-oxygen hot gas provided to the low-oxygen hot gas entry duct.

Example 6 is the system of example 3, further comprising an exhaust tube coupled to the decoating kiln for removing exhaust gas from the decoating kiln, wherein the exhaust gas contains a sufficiently low percentage of free oxygen to be incombustible.

Example 7 is the system of example 1, wherein: the low-oxygen hot gas is less than approximately 10 percent oxygen; and wherein the high-oxygen hot gas is between approximately 5 percent oxygen and 25 percent oxygen.

Example 8 is a method comprising: passing coated scrap through a low-oxygen zone of a decoating kiln; and passing coated scrap through a high-oxygen zone of the decoating kiln.

Example 9 is the method of example 8, further comprising: removing exhaust gas and entrained scrap from the decoating kiln; and separating the entrained scrap from the exhaust gas.

Example 10 is the method of example 9, further comprising: providing the exhaust gas to a burner-fired chamber; providing air to the burner-fired chamber; burning the exhaust gas and the air to generate a low-oxygen hot gas; and providing the low-oxygen hot gas to the decoating kiln proximate the low-oxygen zone.

Example 11 is the method of example 8, further comprising: providing low-oxygen hot gas that is less than approximately 10 percent oxygen along the low-oxygen zone; and providing high-oxygen hot gas that is between approximately 5 percent oxygen and 25 percent oxygen along the high-oxygen zone.

What is claimed is:

1. A decoating kiln, comprising:

a rotating drum supported between a first chamber and a second chamber, the rotating drum comprising:

an entry side for accepting metal scrap and a low-oxygen hot gas into the rotating drum; and an exit side for outputting decoated scrap from the rotating drum and accepting a high-oxygen hot gas into the rotating drum;

an exhaust tube positioned within the rotating drum for exhausting a mixture of exhaust gas and entrained scrap;

a cyclone coupled to the exhaust tube for separating the entrained scrap from the exhaust gas;

an exit port coupled to the cyclone for exhausting the exhaust gas; and a high-oxygen hot gas entry duct in the second chamber configured to direct high-oxygen hot gas into the second chamber such that the high-oxygen hot gas enters the rotating drum at the exit side.

2. The decoating kiln of claim 1, further comprising:

a multicyclone coupled to the exit port for separating particles from the exhaust gas; and a burner-fired chamber coupled to the multicyclone for accepting the exhaust gas and generating the low-oxygen hot gas.

3. The decoating kiln of claim 2, further comprising:

a low-oxygen hot gas entry duct coupled to the decoating kiln proximate the entry side.

4. The decoating kiln of claim 3, wherein:

the exhaust tube is configured to remove exhaust gas from the decoating kiln; and the burner-fired chamber uses at least a portion of the exhaust gas to generate a low-oxygen hot gas provided to the low-oxygen hot gas entry duct.

5. The decoating kiln of claim 1, further comprising:

a low-oxygen hot gas entry duct coupled to the decoating kiln proximate the entry side.

6. The decoating kiln of claim 1, wherein:

the low-oxygen hot gas is less than approximately 10 percent oxygen; and wherein the high-oxygen hot gas is between approximately 5 percent oxygen and 25 percent oxygen.

7. A system, comprising:

the decoating kiln of claim 1 comprising a low-oxygen zone proximate the entry side and a high-oxygen zone proximate the exit side.

8. The system of claim 7, further comprising:

a low-oxygen hot gas entry duct coupled to the decoating kiln proximate the entry side.

9. The system of claim 8, further comprising:

the exhaust tube coupled to the decoating kiln for removing exhaust gas from the decoating kiln; and a burner-fired chamber coupled to the exhaust tube and the low-oxygen hot gas entry duct, wherein the burner-fired chamber uses at least a portion of the exhaust gas to generate a low-oxygen hot gas provided to the low-oxygen hot gas entry duct.

10. The system of claim 7, further comprising an exhaust tube coupled to the decoating kiln for removing exhaust gas from the decoating kiln, wherein the exhaust gas comprises a free oxygen level such that the exhaust gas is incombustible.

11. The system of claim 7, wherein:

the low-oxygen hot gas is less than approximately 10 percent oxygen; and wherein the high-oxygen hot gas is between approximately 5 percent oxygen and 25 percent oxygen.

12. A method of using the decoating kiln of claim 1, comprising:

passing coated scrap through a low-oxygen zone of the decoating kiln; and passing coated scrap through a high-oxygen zone of the decoating kiln.

13. The method of claim 12, further comprising:

removing exhaust gas and entrained scrap from the decoating kiln;

separating the entrained scrap from the exhaust gas.

14. The method of claim 12, further comprising:

providing the exhaust gas to a burner-fired chamber;

providing air to the burner-fired chamber;

burning the exhaust gas and the air to generate a low-oxygen hot gas;

providing the low-oxygen hot gas to the decoating kiln proximate the low-oxygen zone.

15. The method of claim 12, further comprising:

providing low-oxygen hot gas that is less than approximately 10 percent oxygen along the low-oxygen zone; and providing high-oxygen hot gas that is between approximately 5 percent oxygen and 25 percent oxygen along the high-oxygen zone.

16. A decoating kiln, comprising:

a rotating drum supported between a first chamber and a second chamber, the rotating drum comprising:

an entry side for accepting metal scrap and a low-oxygen hot gas into the rotating drum; and an exit side for outputting decoated scrap from the rotating drum and accepting a high-oxygen hot gas into the rotating drum;

an exhaust tube positioned within the rotating drum for exhausting a mixture of exhaust gas and entrained scrap;

a cyclone coupled to the exhaust tube for separating the entrained scrap from the exhaust gas;

an exit port coupled to the cyclone for exhausting the exhaust gas; and a high-oxygen hot gas entry duct in the second chamber configured to allow high-oxygen hot gas to enter the rotating drum at the exit side, wherein the decoating kiln further comprises:

a multicyclone coupled to the exit port for separating particles from the exhaust gas; and a burner-fired chamber coupled to the multicyclone for accepting the exhaust gas and generating the low-oxygen hot gas.

* * * * *